US012031258B2

(12) United States Patent
Lv et al.

(10) Patent No.: US 12,031,258 B2
(45) Date of Patent: Jul. 9, 2024

(54) CLOTHING TREATMENT APPARATUS

(71) Applicants: QINGDAO HAIER WASHING MACHINE CO., LTD., Qingdao (CN); Haier Smart Home Co., Ltd., Qingdao (CN)

(72) Inventors: Peishi Lv, Qingdao (CN); Sheng Xu, Qingdao (CN); Zhiqiang Zhao, Qingdao (CN); Xinyu Zhao, Qingdao (CN)

(73) Assignees: QINGDAO HAIER WASHING MACHINE CO., LTD., Qingdao (CN); Haier Smart Home Co., Ltd., Qingdao (CN)

( * ) Notice: Subject to any disclaimer, the term of this patent is extended or adjusted under 35 U.S.C. 154(b) by 335 days.

(21) Appl. No.: 17/635,213

(22) PCT Filed: Aug. 10, 2020

(86) PCT No.: PCT/CN2020/108141
§ 371 (c)(1),
(2) Date: Feb. 14, 2022

(87) PCT Pub. No.: WO2021/027766
PCT Pub. Date: Feb. 18, 2021

(65) Prior Publication Data

US 2022/0220654 A1 Jul. 14, 2022

(30) Foreign Application Priority Data

Aug. 13, 2019 (CN) ..... 201910745965.6

(51) Int. Cl.
*D06F 34/28* (2020.01)

(52) U.S. Cl.
CPC ..... *D06F 34/28* (2020.02)

(58) Field of Classification Search
CPC ..... D06F 34/28
See application file for complete search history.

(56) References Cited

U.S. PATENT DOCUMENTS

2007/0022544 A1 2/2007 Son

FOREIGN PATENT DOCUMENTS

CN 1445408 A 10/2003
CN 1566440 A 1/2005
(Continued)

OTHER PUBLICATIONS

International Search Report mailed Nov. 16, 2020, in corresponding to International Application No. PCT/CN2020/108141; 6 pages (with English Translation).

*Primary Examiner* — Jason Y Ko
(74) *Attorney, Agent, or Firm* — Maier & Maier, PLLC

(57) ABSTRACT

A clothing treatment apparatus, including a control panel, a power supply button, a parameter setting interface, a starting-and-stopping button and a preference button are arranged on the control panel the clothing treatment apparatus is set to be operated according to an intelligent clothing treatment procedure when the starting-and-stopping button is directly operated after the power supply button is operated; the clothing treatment apparatus is further arranged to be operated according to a pre-stored preference clothing treatment procedure when the preference button and the starting-and-stopping button are sequentially operated after the power supply button is operated; and the clothing treatment apparatus is further arranged to be operated according to a defined clothing treatment procedure when the parameter setting interface and the starting-and-stopping button are sequentially operated after the power supply button is operated.

10 Claims, 4 Drawing Sheets

(56) References Cited

FOREIGN PATENT DOCUMENTS

| | | | |
|---|---|---|---|
| CN | 101407986 | A | 4/2009 |
| CN | 102912590 | A | 2/2013 |
| CN | 107523964 | A | 12/2017 |
| CN | 109468802 | A | 3/2019 |
| JP | 2008-295907 | A | 12/2008 |

CLOTHING TREATMENT APPARATUS

FIELD

The present disclosure belongs to the technical field of clothing treatment, and specifically provides a clothing treatment apparatus.

BACKGROUND

A clothing treatment apparatus is an apparatus capable of washing, drying, sterilizing and/or deodorizing clothing. Existing clothing treatment apparatuses include a washing machine, a clothing dryer, a washing-drying integrated machine, a clothing care machine, etc. Taking the washing machine as an example, in all existing washing machines, a power button is activated first, and then after a user puts the clothing into the washing machine, the user needs to select corresponding washing parameters on a control panel of the washing machine; then the user clicks a start/stop button, and the washing machine generates a washing program according to the washing parameters set by the user so that the clothing is washed. However, this operation mode requires the user to set the washing parameters every time the washing machine is used, which causes great inconvenience to the user.

Accordingly, there is a need in the art for a new clothing treatment apparatus to solve the above problem.

SUMMARY

In order to solve the above problem in the prior art, namely, to solve the problem of inconvenient operation of users of the existing clothing treatment apparatuses, the present disclosure provides a clothing treatment apparatus, which includes a control panel, on which a power button, a parameter setting interface and a start/stop button are provided; the control panel is also provided with a preference button, and the clothing treatment apparatus is configured to run a smart clothing treatment program when the start/stop button is directly operated after the power button is operated; the clothing treatment apparatus is further configured to run a pre-stored preference clothing treatment program when the preference button and the start/stop button are operated in sequence after the power button is operated; and the clothing treatment apparatus is further configured to run a customized clothing treatment program when the parameter setting interface and the start/stop button are operated in sequence after the power button is operated.

In a preferred technical solution of above clothing treatment apparatus, the control panel includes a first control area and a second control area, in which the power button, the start/stop button and the preference button are all provided in the first control area, and the parameter setting interface is provided in the second control area.

In a preferred technical solution of above clothing treatment apparatus, the first control area is located on a front side of the second control area.

In a preferred technical solution of above clothing treatment apparatus, the start/stop button is arranged between the power button and the preference button.

In a preferred technical solution of above clothing treatment apparatus, the parameter setting interface includes at least one of a mode setting functional button, a number-of-times setting functional button, a time setting functional button and a temperature setting functional button.

In a preferred technical solution of above clothing treatment apparatus, the parameter setting interface is a touch-type parameter setting interface.

In a preferred technical solution of above clothing treatment apparatus, the parameter setting interface is a push-button parameter setting interface.

In a preferred technical solution of above clothing treatment apparatus, a part of the parameter setting interface is a touch-type parameter setting interface, and the other part of the parameter setting interface is a push-button parameter setting interface.

In a preferred technical solution of above clothing treatment apparatus, the power button is a touch button or a push button, the start/stop button is a touch button or a push button, and the preference button is a touch button or a push button.

The present disclosure further provides a clothing treatment apparatus, which includes a control panel, on which a power button, a parameter setting interface and a start/stop button are provided; the clothing treatment apparatus is configured to run a smart clothing treatment program when the start/stop button is directly operated after the power button is operated, and the clothing treatment apparatus is further configured to run a customized clothing treatment program when the parameter setting interface and the start/stop button are operated in sequence after the power button is operated.

It can be understood by those skilled in the art that in the preferred technical solutions of the present disclosure, the clothing treatment apparatus provides three operating modes for the user: when the user does not need to set the clothing treatment parameters, after operating the power button, the user can directly operate the start/stop button, or operate the preference button and the start/stop button in sequence, in which operating the start/stop button directly can make the clothing treatment apparatus run the smart clothing treatment program, and operating the preference button and the start/stop button in sequence can make the clothing treatment apparatus run the pre-stored preference clothing treatment program; and when the user needs to set the clothing treatment parameters, the user can operate the parameter setting interface and the start/stop button in sequence after operating the power button, so that the clothing treatment apparatus runs the customized clothing treatment program. With such arrangements, the clothing treatment apparatus can meet various needs of the user, greatly simplify the user's operations, reduce the difficulty and time for the user to operate the clothing treatment apparatus, improve the convenience in operating the clothing treatment apparatus for the user, and improve the user experience.

Further, the power button, the start/stop button and the preference button are all provided in the first control area, and the parameter setting interface is provided in the second control area, so that the power button, the start/stop button and the preference button, which are buttons most frequently used by the user, are separated by certain distances from the parameter setting interface, and that the user will not misoperate the parameter setting interface when operating the power button, the start/stop button or the preference button; moreover, if the user does not need to custom parameters after operating the power button, the start/stop button or the preference button can be quickly operated at a close distance, thereby further improving the convenience of the user's operations and further improving the user experience.

Further, the first control area is located on a front side of the second control area, so that the user can operate the power button, the start/stop button and the preference button at a closer distance, thereby further improving the user experience.

The present disclosure further provides another clothing treatment apparatus, which provides two operating modes for the user: when the user does not need to set the clothing treatment parameters, after operating the power button, the user can directly operate the start/stop button, so that the clothing treatment apparatus runs the smart clothing treatment program; and when the user needs to set the clothing treatment parameters, the user can operate the parameter setting interface and the start/stop button in sequence after operating the power button, so that the clothing treatment apparatus runs the customized clothing treatment program. With such arrangements, the clothing treatment apparatus can meet various needs of the user, greatly simplify the user's operations, reduce the difficulty and time for the user to operate the clothing treatment apparatus, improve the convenience in operating the clothing treatment apparatus for the user, and improve the user experience.

BRIEF DESCRIPTION OF DRAWINGS

Hereinafter, preferred embodiments of the present disclosure will be described with reference to the accompanying drawings and in connection with a washing machine. In the drawings.

DETAILED DESCRIPTION

First of all, it should be understood by those skilled in the art that these embodiments are only used to explain the technical principles of the present disclosure, and are not intended to limit the scope of protection of the present disclosure. For example, although the present disclosure is explained and described in connection with a washing machine, it is obvious that the technical solutions of the present disclosure may also be applied to a clothing dryer, a washing-drying integrated machine, a clothing care machine, etc. Such adjustments and changes to the application objects do not limit the present disclosure, and should each be defined within the scope of protection of the present disclosure.

It should be noted that in the description of the present disclosure, terms indicating directional or positional relationships, such as "in", "upper", "lower", "front", "rear", "left", "right", "inner", "outer" and the like, are based on the directional or positional relationships shown in the accompanying drawings. They are only used for ease of description, and do not indicate or imply that the device or element must have a specific orientation, or be constructed or operated in a specific orientation, and therefore they should not be considered as limitations to the present disclosure. In addition, terms "first" and "second" are only used for descriptive purposes, and should not be understood as indicating or implying relative importance.

Based on the problem of inconvenient operation of users of existing washing machines, which is pointed out in the "BACKGROUND", the present disclosure provides a washing machine, aiming at enabling the washing machine to meet various needs of the user, greatly simplifying the user's operations, reducing the difficulty and time for the user to operate the washing machine, improving the convenience in operating the washing machine for the user, and improving the user experience.

First Embodiment

Figure 1:
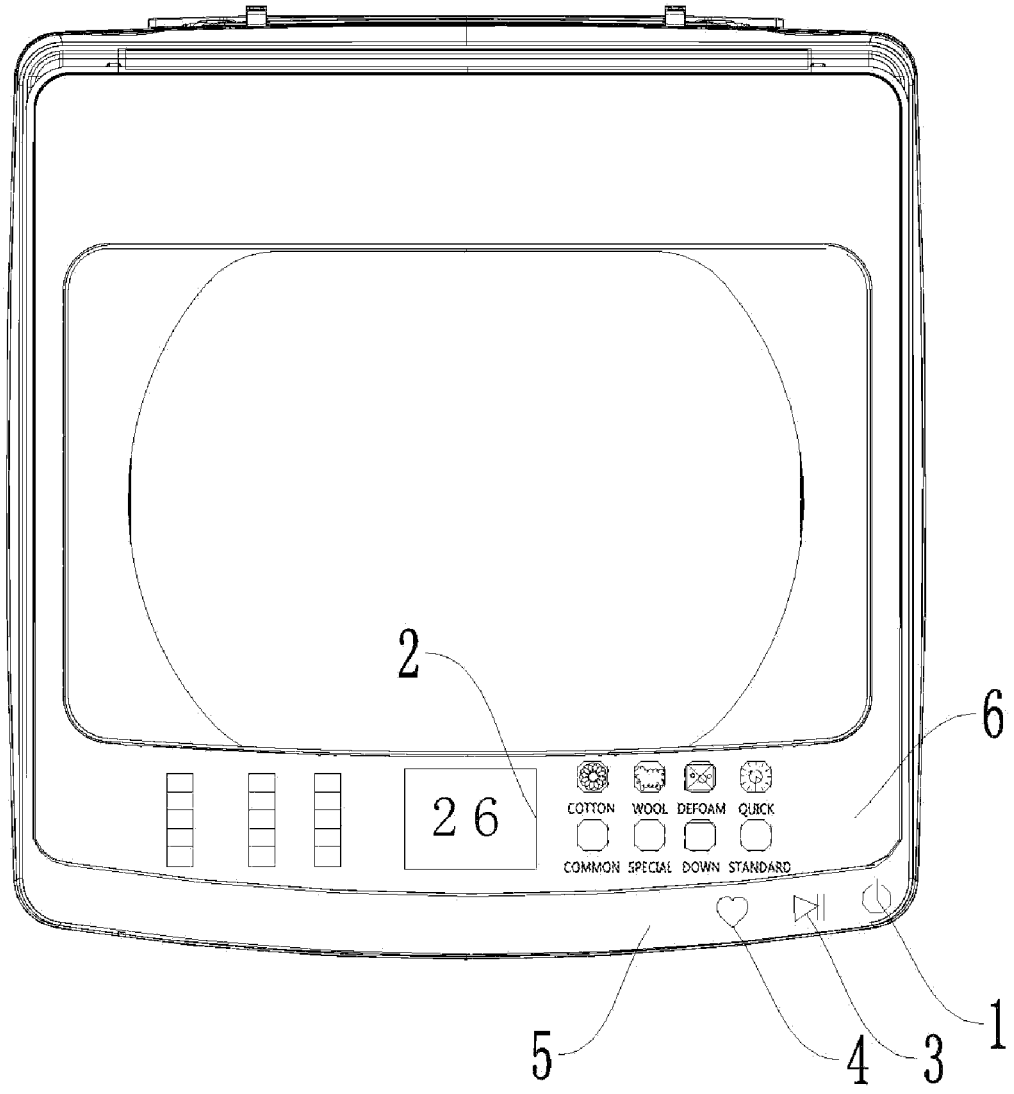
FIG. 1 is a schematic structural view of a situation of a first embodiment of a washing machine according to the present disclosure.
Figure 2:
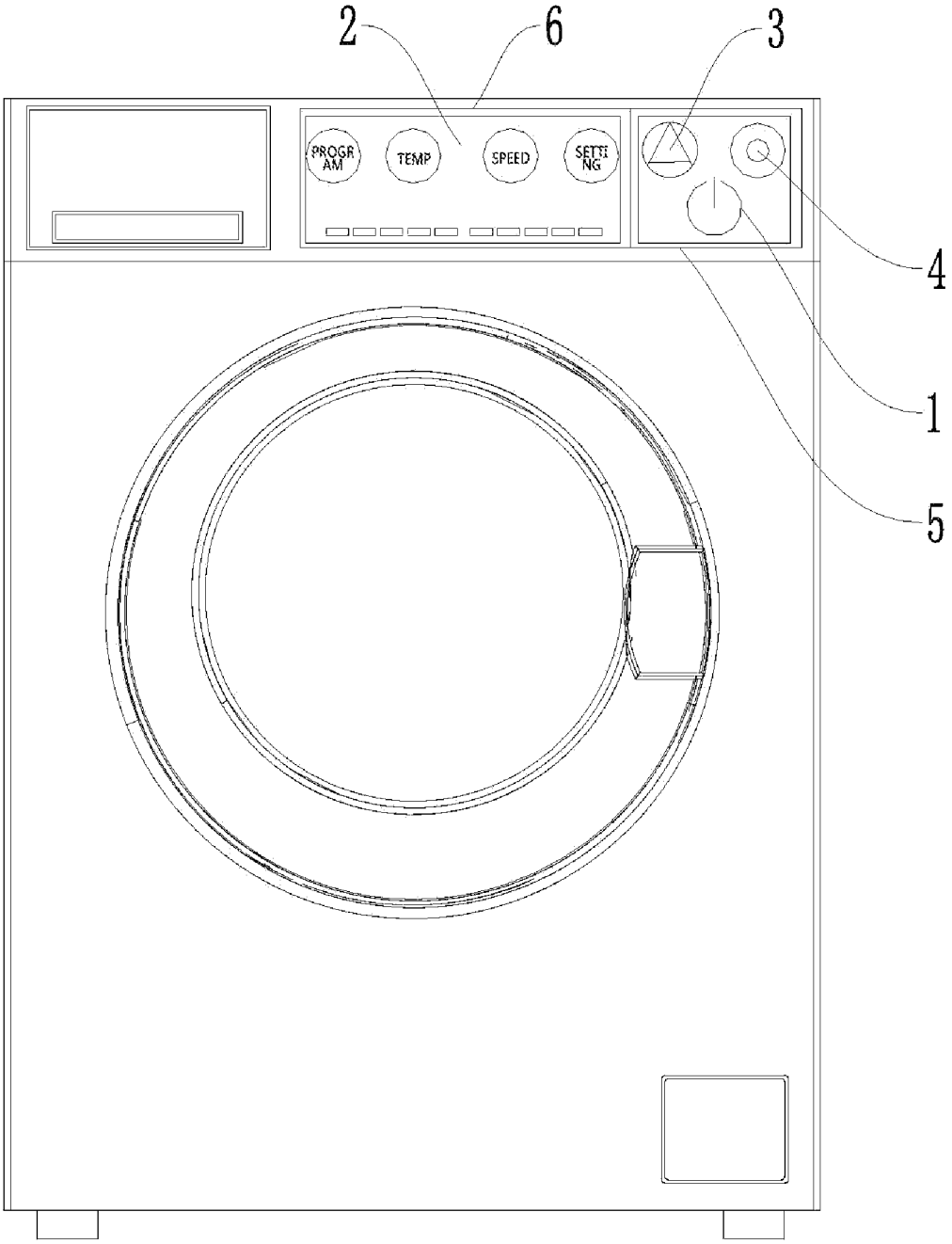
FIG. 2 is a schematic structural view of another situation of the first embodiment of the washing machine according to the present disclosure.

As shown in FIGS. 1 and 2, the washing machine of the present disclosure includes a control panel, on which a power button 1, a parameter setting interface 2 and a start/stop button 3 are provided; the control panel is also provided with a preference button 4, and the washing machine is configured to run a smart clothing treatment program when the start/stop button 3 is directly operated after the power button 1 is operated; the washing machine is further configured to run a pre-stored preference clothing treatment program when the preference button 4 and the start/stop button 3 are operated in sequence after the power button 1 is operated; and the washing machine is further configured to run a customized clothing treatment program when the parameter setting interface 2 and the start/stop button 3 are operated in sequence after the power button 1 is operated. The smart clothing treatment program means that the washing machine does not need the user to set clothing treatment parameters; instead, the washing machine detects by itself and washes, rinses and spins the clothing, etc. The smart clothing treatment program can be flexibly set based on modules provided on the washing machine. For example, the washing machine has an image collector, and the image collector is electrically connected to a controller of the washing machine. The image collector is capable of collecting image information of the clothing, and then the image collector sends the collected image information to the controller of the washing machine. The controller processes the image information to identify the material and color of the clothing, so as to wash the clothing of different materials and/or colors in a targeted manner. For another example, the washing machine has an RFID identifier, which is electrically connected to the controller of the washing machine. The RFID identifier is capable of identifying an electronic tag on the clothing, and then the RFID identifier sends the identified tag information to the controller. The controller analyzes the tag information, and then runs a clothing treatment program corresponding to the tag information. Those skilled in the art may flexibly set the smart clothing treatment program of the washing machine according to the specific structure and function of the washing machine in practical applications. The pre-stored preference clothing treatment program refers to a clothing treatment program defined and stored by the user in advance; when using the washing machine, users often like to set a program of their own preference, and by operating the parameter setting interface 2, the user can click "save" after the operation is completed, and then store their favorite clothing treatment programs. The customized clothing treatment program means that the washing machine requires the user to set the clothing treatment parameters, then the washing machine generates a clothing treatment program according to all the clothing treatment operations set by the user, and then runs the newly generated clothing treatment program.

In a possible situation, there is a save button in the parameter setting interface 2. After the user operates the power button 1, the user can select parameters on the parameter setting interface 2, and then operates the save button; the washing machine saves a clothing treatment program corresponding to all the parameters selected by the user as the preference clothing treatment program. In another possible situation, after the user operates the power button 1, the user can select parameters on the parameter setting interface 2, and then operates the preference button 4; the washing machine saves a clothing treatment program corresponding to all the parameters selected by the user as the preference clothing treatment program. In the above two situations, when the user wants to change the preference clothing treatment program, he/she can delete the previous preference clothing treatment program, and then set the preference clothing treatment program again; alternatively, the user can directly set a new preference clothing treatment program, and the new preference clothing treatment program then overwrites the previous preference clothing treatment program.

In this embodiment, the power button 1 is a touch button or a push button, the start/stop button 3 is a touch button or a push button, and the preference button 4 is a touch button or a push button. In a possible situation, the power button 1, the start/stop button 3 and the preference button 4 are all push buttons. When the user presses the power button 1, a control circuit of the controller of the washing machine is turned on, the washing machine is powered on, and then waits for the user's next operation. If the user directly presses the start/stop button 3, the washing machine runs the smart clothing treatment program; if the user presses the preference button 4 and the start/stop button 3 in sequence, the washing machine runs the preference clothing treatment program; and if the user operates the parameter setting interface 2 and then presses the start/stop button 3, the washing machine runs the customized clothing treatment program. No matter which clothing treatment program the washing machine is running, the user can press the start/stop button 3 to stop the current operation of the washing machine. When the start/stop button 3 is pressed again, the washing machine resumes the previous operation, or continues to operate according to the program newly set by the user. In another possible situation, the power button 1, the start/stop button 3 and the preference button 4 are all touch buttons. When the user touches the power button 1, the control circuit of the controller of the washing machine is turned on, the washing machine is powered on, and then waits for the user's next operation. If the user directly touches the start/stop button 3, the washing machine runs the smart clothing treatment program; if the user touches the preference button 4 and the start/stop button 3 in sequence, the washing machine runs the preference clothing treatment program; and if the user operates the parameter setting interface 2 and then touches the start/stop button 3, the washing machine runs the customized clothing treatment program. No matter which clothing treatment program the washing machine is running, the user can touch the start/stop button 3 to stop the current operation of the washing machine. When the start/stop button 3 is touched again, the washing machine resumes the previous operation, or continues to operate according to the program newly set by the user. In addition, in this embodiment, the parameter setting interface 2 may be a touch-type parameter setting interface 2, or a push-button parameter setting interface 2, or a part of the parameter setting interface 2 is a touch-type parameter setting interface 2, and the other part of the parameter setting interface 2 is a push-button parameter setting interface 2. Specifically, when the power button 1, the start/stop button 3 and the preference button 4 are all push buttons, the parameter setting interface 2 preferably adopts the push-button parameter setting interface 2, so as to facilitate the overall design of the control panel; and when the power button 1, the start/stop button 3 and the preference button 4 are all touch buttons, the parameter setting interface 2 preferably adopts the touch-type parameter setting interface 2, so as to facilitate the overall design of the control panel. Of course, the power button 1, the start/stop button 3, the preference button 4 and the parameter setting interface 2 may also be in the form of a push-button type alternate with a touch type, and those skilled in the art can flexibly design the control panel according to the user's needs and the overall structure of the washing machine in practical applications.

Preferably, the control panel includes a first control area 5 and a second control area 6, in which the power button 1, the start/stop button 3 and the preference button 4 are all provided in the first control area 5, and the parameter setting interface 2 is provided in the second control area 6. By providing the three most frequently used buttons (i.e., the power button 1, the start/stop button 3 and the preference button 4) in the same control area, and providing the parameter setting interface 2 in another control area, on one hand, user's misoperation can be avoided, and on the other hand, since a possibility that the user chooses the smart clothing treatment and the preference clothing treatment in practical applications is higher than a possibility that the user chooses the customized clothing treatment, such an arrangement may facilitate the user to directly operate the start/stop button 3 nearby or operate the preference button 4 and the start/stop button 3 in sequence after operating the power button 1. In practical applications, if the control panel is arranged on a top of a cabinet of the washing machine or a tray (as shown in FIG. 1), the first control area 5 may be located on a front side of the second control area 6, or may be located on a left side or a right side of the second control area 6, or may be located on a rear side of the second control area 6. If the control panel is arranged at a front of the cabinet of the washing machine or the tray (as shown in FIG. 2), the first control area 5 may be located on an upper side of the second control area 6, or may be located on the left side or the right side of the second control area 6, or may be located on a lower side of the second control area 6. Those skilled in the art may flexibly set a relative position of the first control area 5 and the second control area 6 in practical applications. Such adjustments to the relative position of the first control area 5 and the second control area 6 do not constitute limitations to the present disclosure, and should all be defined within the scope of protection of the present disclosure. Since the control panel is typically arranged at the top of the cabinet of the washing machine or the tray, and the user generally operates the washing machine from the front of the washing machine, it is most preferable to set the first control area 5 on the front side of the second control area 6, so that the user can operate the power button 1, the start/stop button 3 and the preference button 4 at the shortest distance.

In a possible situation, the start/stop button 3 is arranged between the power button 1 and the preference button 4. As shown in FIG. 1, the preference button 4, the start/stop button 3 and the power button 1 are arranged on the control panel laterally from left to right in the shape of a "-". When the user wants the washing machine to run the smart clothing treatment program, he/she only needs to slightly move the finger to the left after operating the power button 1, and then operate the start/stop button 3 again so that the washing machine can run the smart clothing treatment program. When the user wants the washing machine to run the preference clothing treatment program, he/she only needs to move the finger to the left after operating the power button 1, and then operate the preference button 4 and the start/stop button 3 in sequence so that the washing machine can run the preference clothing treatment program. Of course, the above example is only a specific arrangement of the preference button 4, the start/stop button 3 and the power button 1, and those skilled in the art can flexibly set specific positions of the preference button 4, the start/stop button 3 and the power button 1 in practical applications. As shown in FIG. 2, the preference button 4, the start/stop button 3 and the power button 1 are arranged in a triangle shape, etc. Such adjustments and changes to the specific positions of the preference button 4, the start/stop button 3 and the power button 1 do not constitute limitations to the present disclosure, and should all be defined within the scope of protection of the present disclosure.

In a possible situation of the present embodiment, the parameter setting interface 2 includes at least one of a mode setting functional button, a number-of-times setting functional button, a time setting functional button and a temperature setting functional button. The mode setting functional button may include a washing mode functional button, a rinsing mode functional button, a spinning mode functional button, and a draining mode functional button, etc. The number-of-times setting functional button may include a one-time functional button, a two-times functional button and a three-times functional button. The time setting functional button may include a 10-minutes functional button, a 15-minutes functional button, a 20-minutes functional button, a 30-minutes functional button, a 60-minutes functional button and a 90-minutes functional button, etc. The temperature setting functional button may include a 20° C. functional button, a 30° C. functional button, a 40° C. functional button and a 50° C. functional button, etc. Of course, in practical applications, the parameter setting interface 2 may also include other types of functional buttons, such as a material setting functional button (a cotton functional button, a hemp functional button and a silk functional button, etc.) and a strength setting functional button (a strong washing functional button, a normal washing functional button and a gentle washing functional button, etc.). Those skilled in the art can flexibly set the specific types of the functional buttons in the parameter setting interface 2 in practical applications. Such adjustments and changes to the specific types of the functional buttons in the parameter setting interface 2 do not constitute limitations to the present disclosure, and should all be defined within the scope of protection of the present disclosure.

It should be noted that in the present embodiment, those skilled in the art can understand that without departing from the basic principle of the present disclosure, there may be a variety of specific ways of directly operating the start/stop button 3 after operating the power button 1 to make the washing machine run the smart clothing treatment program, operating the preference button 4 and the start/stop button 3 in sequence after operating the power button 1 to make the washing machine run the pre-stored preference clothing treatment program, and operating the parameter setting interface 2 and the start/stop button 3 in sequence after operating the power button 1 to make the washing machine run the customized clothing treatment program, all of which should not constitute any limitation to the scope of protection of the present disclosure. For example, although the correspondences between different buttons or button combinations and specific functions are usually realized by means of logical fields in a control algorithm of the washing machine, this is not limiting, and it can also be realized by those skilled in the art by using hardware or a combination of hardware and software algorithms.

Second Embodiment

Figure 3:
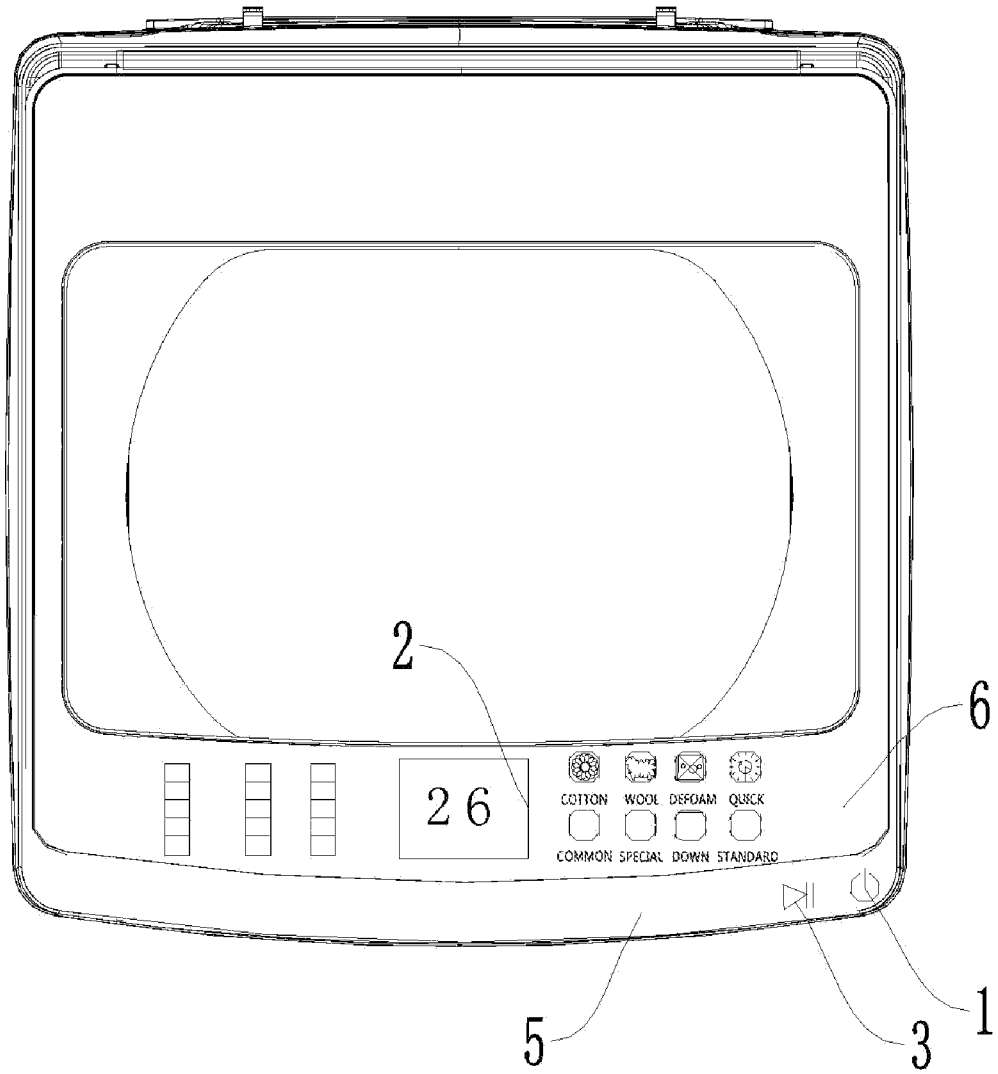
FIG. 3 is a schematic structural view of a situation of a second embodiment of the washing machine according to the present disclosure.
Figure 4:
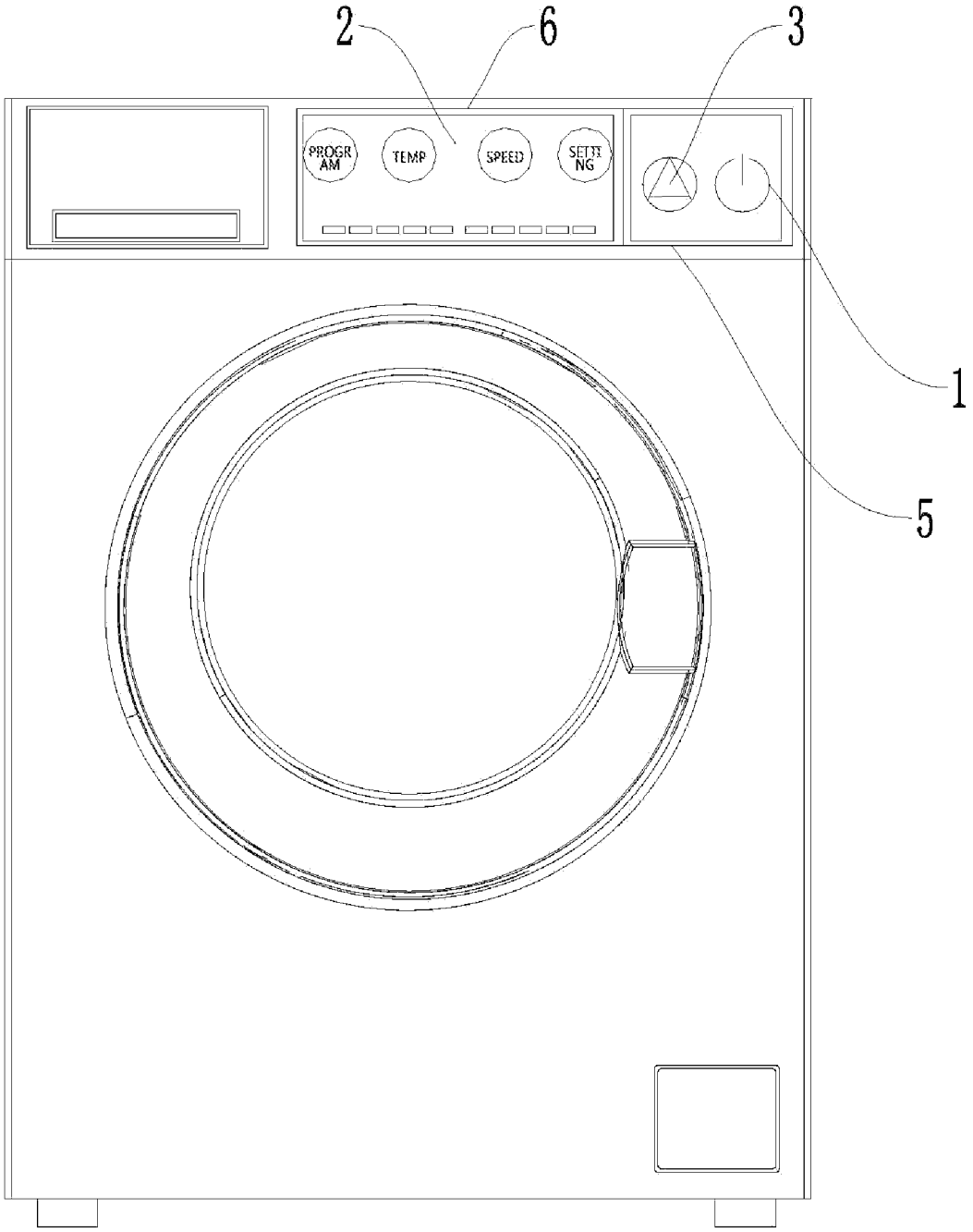
FIG. 4 is a schematic structural view of another situation of the second embodiment of the washing machine according to the present disclosure.

As shown in FIGS. 3 and 4, the washing machine of the present disclosure includes a control panel, on which a power button 1, a parameter setting interface 2 and a start/stop button 3 are provided; the washing machine is configured to run a smart clothing treatment program when the start/stop button 3 is directly operated after the power button 1 is operated; and the washing machine is further configured to run a customized clothing treatment program when the parameter setting interface 2 and the start/stop button 3 are operated in sequence after the power button 1 is operated. Like the first embodiment, the smart clothing treatment program means that the washing machine does not need the user to set clothing treatment parameters; instead, the washing machine detects by itself and washes, rinses and spins the clothing, etc. The smart clothing treatment program can be flexibly set based on modules provided on the washing machine. For example, the washing machine has an image collector, and the image collector is electrically connected to a controller of the washing machine. The image collector is capable of collecting image information of the clothing, and then the image collector sends the collected image information to the controller of the washing machine. The controller processes the image information to identify the material and color of the clothing, so as to wash the clothing of different materials and/or colors in a targeted manner. For another example, the washing machine has an RFID identifier, which is electrically connected to the controller of the washing machine. The RFID identifier is capable of identifying an electronic tag on the clothing, and then the RFID identifier sends the identified tag information to the controller. The controller analyzes the tag information, and then runs a clothing treatment program corresponding to the tag information. Those skilled in the art may flexibly set the smart clothing treatment program of the washing machine according to the specific structure and function of the washing machine in practical applications. The customized clothing treatment program means that the washing machine requires the user to set the clothing treatment parameters, then the washing machine generates a clothing treatment program according to all the clothing treatment operations set by the user, and then runs the newly generated clothing treatment program.

In this embodiment, the power button 1 is a touch button or a push button, and the start/stop button 3 is a touch button or a push button. In a possible situation, the power button 1 and the start/stop button 3 are both push buttons. When the user presses the power button 1, a control circuit of the controller of the washing machine is turned on, the washing machine is powered on, and then waits for the user's next operation. If the user directly presses the start/stop button 3, the washing machine runs the smart clothing treatment program; and if the user operates the parameter setting interface 2 and then presses the start/stop button 3, the washing machine runs the customized clothing treatment program. No matter which clothing treatment program the washing machine is running, the user can press the start/stop button 3 to stop the current operation of the washing machine. When the start/stop button 3 is pressed again, the washing machine resumes the previous operation, or continues to operate according to the program newly set by the user. In another possible situation, the power button 1 and the start/stop button 3 are both touch buttons. When the user touches the power button 1, the control circuit of the controller of the washing machine is turned on, the washing machine is powered on, and then waits for the user's next operation. If the user directly touches the start/stop button 3, the washing machine runs the smart clothing treatment program; and if the user operates the parameter setting interface 2 and then touches the start/stop button 3, the washing machine runs the customized clothing treatment program. No matter which clothing treatment program the washing machine is running, the user can touch the start/stop button 3 to stop the current operation of the washing machine. When the start/stop button 3 is touched again, the washing machine resumes the previous operation, or continues to operate according to the program newly set by the user. In addition, in this embodiment, the parameter setting interface 2 may be a touch-type parameter setting interface 2, or a push-button parameter setting interface 2, or a part of the parameter setting interface 2 is a touch-type parameter setting interface 2, and the other part of the parameter setting interface 2 is a push-button parameter setting interface 2. Specifically, when the power button 1 and the start/stop button 3 are both push buttons, the parameter setting interface 2 preferably adopts the push-button parameter setting interface 2, so as to facilitate the overall design of the control panel; and when the power button 1 and the start/stop button 3 are both touch buttons, the parameter setting interface 2 preferably adopts the touch-type parameter setting interface 2, so as to facilitate the overall design of the control panel. Of course, the power button 1, the start/stop button 3 and the parameter setting interface 2 may also be in the form of a push-button type alternate with a touch type, and those skilled in the art can flexibly design the control panel according to the user's needs and the overall structure of the washing machine in practical applications.

Preferably, the control panel includes a first control area 5 and a second control area 6, in which the power button 1 and the start/stop button 3 are both provided in the first control area 5, and the parameter setting interface 2 is provided in the second control area 6. By providing the two most frequently used buttons (i.e., the power button 1 and the start/stop button 3) in the same control area, and providing the parameter setting interface 2 in another control area, on one hand, user's misoperation can be avoided, and on the other hand, since a possibility that the user chooses the smart clothing treatment in practical applications is higher than a possibility that the user chooses the customized clothing treatment, such an arrangement may facilitate the user to directly operate the start/stop button 3 nearby. In practical applications, if the control panel is arranged on a top of a cabinet of the washing machine or a tray (as shown in FIG. 3), the first control area 5 may be located on a front side of the second control area 6, or may be located on a left side or a right side of the second control area 6, or may be located on a rear side of the second control area 6. If the control panel is arranged at a front of the cabinet of the washing machine or the tray (as shown in FIG. 4), the first control area 5 may be located on an upper side of the second control area 6, or may be located on the left side or the right side of the second control area 6, or may be located on a lower side of the second control area 6. Those skilled in the art may flexibly set a relative position of the first control area 5 and the second control area 6 in practical applications. Such adjustments to the relative position of the first control area 5 and the second control area 6 do not constitute limitations to the present disclosure, and should all be defined within the scope of protection of the present disclosure. Since the control panel is typically arranged at the top of the cabinet of the washing machine or the tray, and the user generally operates the washing machine from the front of the washing machine, it is most preferable to set the first control area 5 on the front side of the second control area 6, so that the user can operate the power button 1 and the start/stop button 3 at the shortest distance.

In a possible situation of the present embodiment, the parameter setting interface 2 includes at least one of a mode setting functional button, a number-of-times setting functional button, a time setting functional button and a temperature setting functional button. The mode setting functional button may include a washing mode functional button, a rinsing mode functional button, a spinning mode functional button, and a draining mode functional button, etc. The number-of-times setting functional button may include a one-time functional button, a two-times functional button and a three-times functional button. The time setting functional button may include a 10-minutes functional button, a 15-minutes functional button, a 20-minutes functional button, a 30-minutes functional button, a 60-minutes functional button and a 90-minutes functional button, etc. The temperature setting functional button may include a 20° C. functional button, a 30° C. functional button, a 40° C. functional button and a 50° C. functional button, etc. Of course, in practical applications, the parameter setting interface 2 may also include other types of functional buttons, such as a material setting functional button (a cotton functional button, a hemp functional button and a silk functional button, etc.) and a strength setting functional button (a strong washing functional button, a normal washing functional button and a gentle washing functional button, etc.). Those skilled in the art can flexibly set the specific types of the functional buttons in the parameter setting interface 2 in practical applications. Such adjustments and changes to the specific types of the functional buttons in the parameter setting interface 2 do not constitute limitations to the present disclosure, and should all be defined within the scope of protection of the present disclosure.

It should be noted that in the present embodiment, those skilled in the art can understand that without departing from the basic principle of the present disclosure, there may be a variety of specific ways of directly operating the start/stop button 3 after operating the power button 1 to make the washing machine run the smart clothing treatment program, and operating the parameter setting interface 2 and the start/stop button 3 in sequence after operating the power button 1 to make the washing machine run the customized clothing treatment program, all of which should not constitute any limitation to the scope of protection of the present disclosure. For example, although the correspondences between different buttons or button combinations and specific functions are usually realized by means of logical fields in a control algorithm of the washing machine, this is not limiting, and it can also be realized by those skilled in the art by using hardware or a combination of hardware and software algorithms.

Hitherto, the technical solutions of the present disclosure have been described in connection with the preferred embodiments shown in the accompanying drawings, but it is easily understood by those skilled in the art that the scope of protection of the present disclosure is obviously not limited to these specific embodiments. Without departing from the principles of the present disclosure, those skilled in the art can make equivalent changes or replacements to relevant technical features, and all the technical solutions after these changes or replacements will fall within the scope of protection of the present disclosure.

What is claimed is:

1. A clothing treatment apparatus, comprising a control panel, on which a power button, a parameter setting interface and a start/stop button are provided;

wherein the control panel is also provided with a preference button;

the clothing treatment apparatus is configured to run a smart clothing treatment program when the start/stop button is directly operated after the power button is operated;

the clothing treatment apparatus is further configured to run a pre-stored preference clothing treatment program when the preference button and the start/stop button are operated in sequence after the power button is operated; and the clothing treatment apparatus is further configured to run a customized clothing treatment program when the parameter setting interface and the start/stop button are operated in sequence after the power button is operated.

2. The clothing treatment apparatus according to claim 1, wherein the control panel comprises a first control area and a second control area;

the power button, the start/stop button and the preference button are all provided in the first control area; and the parameter setting interface is provided in the second control area.

3. The clothing treatment apparatus according to claim 2, wherein the first control area is located on a front side of the second control area.

4. The clothing treatment apparatus according to claim 1, wherein the start/stop button is arranged between the power button and the preference button.

5. The clothing treatment apparatus according to claim 1, wherein the parameter setting interface comprises at least one of a mode setting functional button, a number-of-times setting functional button, a time setting functional button and a temperature setting functional button.

6. The clothing treatment apparatus according to claim 1, wherein the parameter setting interface is a touch-type parameter setting interface.

7. The clothing treatment apparatus according to claim 1, wherein the parameter setting interface is a push-button parameter setting interface.

8. The clothing treatment apparatus according to claim 1, wherein a part of the parameter setting interface is a touch-type parameter setting interface, and the other part of the parameter setting interface is a push-button parameter setting interface.

9. The clothing treatment apparatus according to claim 1, wherein the power button is a touch button or a push button, the start/stop button is a touch button or a push button, and the preference button is a touch button or a push button.

10. A clothing treatment apparatus, comprising a control panel, on which a power button, a parameter setting interface and a start/stop button are provided;

wherein the clothing treatment apparatus is configured to run a smart clothing treatment program when the start/stop button is directly operated after the power button is operated, and the clothing treatment apparatus is further configured to run a customized clothing treatment program when the parameter setting interface and the start/stop button are operated in sequence after the power button is operated.

* * * * *